United States Patent [19]

Weiner

[11] 4,318,067

[45] Mar. 2, 1982

[54] FLAT-TYPE TRANSFORMER

[76] Inventor: Norbert Weiner, D-5275 Bergneustadt 2, Fed. Rep. of Germany

[21] Appl. No.: 170,563

[22] Filed: Jul. 21, 1980

[30] Foreign Application Priority Data

Jul. 26, 1979 [DE] Fed. Rep. of Germany ..... 2930387

[51] Int. Cl.³ ..... H01F 27/02; H01F 27/30

[52] U.S. Cl. ..... 336/90; 336/98; 336/192; 336/198

[58] Field of Search ..... 336/98, 198, 208, 192, 336/90, 92

[56] References Cited

U.S. PATENT DOCUMENTS 3,947,796 3/1976 Postma et al. ..... 336/198 X

FOREIGN PATENT DOCUMENTS 2310974 9/1973 Fed. Rep. of Germany ..... 336/198

1240795 7/1971 United Kingdom ..... 336/198

*Primary Examiner*—Thomas J. Kozma

*Attorney, Agent, or Firm*—Freilich, Hornbaker, Wasserman, Rosen & Fernandez

[57] ABSTRACT

A flat-type transformer comprises in one embodiment of two spaced-apart coil arrangements. Each arrangement includes a flanged coil form on which a coil is wound. Each of these arrangements further includes an L-shaped strip which supports terminals. One arm of the L-shaped strip extends into the coil form and the other arm extends out of the coil form and is spaced from the flange to form a gap. A third coil arrangement with a strip which forms a T shape with the coil form is also included. A housing with pockets for surrounding the coil arrangement is provided. It has cutouts which exend into said gaps.

11 Claims, 11 Drawing Figures

FLAT-TYPE TRANSFORMER

BACKGROUND OF THE INVENTION

1. Field of the Invention:

The present invention relates to a flat transformer and more particularly to improvements thereof.

2. Description of the Prior Art:

So-called flat transformers whose coil arrangements are compound-filled, are known. In addition to being subjected to external temperatures during continuous operation, they are subject to intolerably high internal temperatures, due to heat buildup, even when the compound is poured without bubbles. Such flat transformers tend to age prematurely, and hence to break down prematurely.

With unpotted transformers, especially miniature versions, there is the problem that the air gaps and the so-called creep paths along the insulating parts of the transformer are not adequately large to provide sufficient insulation of the coil windings with respect to one another, and between the coil windings and the iron core, resp. its yoke, to meet satisfactory operation.

SUMMARY OF THE INVENTION

The present invention provides a flat transformer, configured so that its insulating properties are significantly improved with respect to conventional, unpotted transformers, even in the smallest possible constructions.

In accordance with the invention this is achieved by providing an insulating housing with a roughly rectangular wave cross section, forming pockets for the coil arrangements of the limbs, to be inserted from different sides, and having cutouts dimensioned according to the respective limb of the iron core at its ends, which are at right angles to the limbs and overlap the corresponding coil form flanges. Because of the special configuration of the pockets within a waved, meander-like housing sleeve and the end-containment of the coil arrangements with the pocket ends, having closely dimensioned cutouts for the limbs of the iron core, the air gaps and creep paths between the coil windings mutually and between the coil windings and the iron core, resp. core yoke, become so large that creep paths and air gaps of 6 mm, as required by German standards, are obtained, even in the smallest possible versions of such transformers.

It is advantageous to provide the cutouts at the ends of the insulating housing fo receiving the coil forms, which are equipped with molded-on strips for the terminals at the outsides of the flanges, forming a gap for the ends of the insulating housing, open toward the open insertion side of the corresponding pocket. Apart from the very simple assembly of the coil arrangements by simple and linear insertion into the pockets of the housing, this accomplishes that the coil form flanges are most extensively enveloped by the ends, resp. ends walls of the housing in the region of the limbs and yokes of the iron core, while the molded-on strips may be placed between the open sides of the cutouts and the iron core as insulating elements.

According to another advantageous configuration of the invention, at least one slot for laying the lead-out wires, open on one side and starting from the wound form of the coil form, merging into the connection plane of the strip, is molded into the flange of each coil form which carries the strip, continuing in the shape of a channel let into the strip, and running to the cited connection plane. The lead-out wires can be very simply laid into these slots, by machine for example, without any curtailment of the length of the above cited air gap and creep path by the placement of the channel between the wound form and the strip-connecting plane.

Additional insulation against contact and external influences, e.g. contamination of the transformer according to the invention is finally obtained with a further part of the insulating housing, having a cover for the open side of at least one coil arrangement, preferably the center of three coil arrangements, having shells molded onto the opposite sides of the cover, configured according to the yokes of the iron core and enclosing these along at least two sides. This cover in the insulating housing can be advantageously utilized to form and define a space for accommodating a thermal safety device.

It is naturally possible in the context of the present invention to vary the transformer with regard to the number of coil forms and the configuration of the iron core in many ways, e.g. with so-called M, EI, UI, and L-formed sections.

The novel features of the invention are set forth with particularity in the appended claims. The invention will best be understood from the following description when read in conjunction with the accompanying drawings.

DESCRIPTION OF THE PREFERRED EMBODIMENTS

Figures 1A, 1B, 1C:
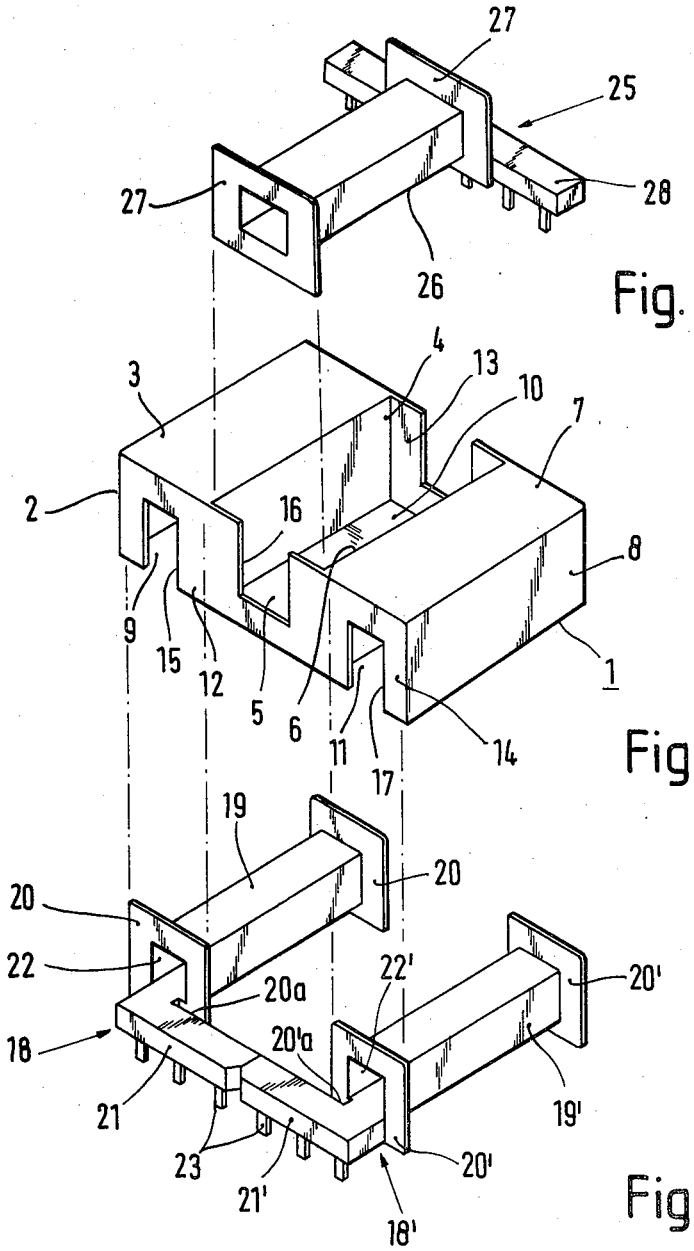
FIGS. 1*a*–1*c* are isometric views of a part of the novel transformers without coil winding and without iron core.

The insulating housing, shown in FIGS. 1*b* and 1*c* which is assumed to be of insulating plastic, has a waveform wall cross section with wall surfaces 2 to 8, enclosing three pockets 9, 10, and 11 on three sides each. At right angles to them, the pockets 9, 10, 11 are closed by end walls, of which the figures shows only the end walls designated 12, 13, and 14. Each of these end walls, contains one cutout 15, resp. 16, resp. 17, whose width corresponds to the width of the limb of the iron core to be described below, and which opens toward the open insertion side of the corresponding pocket.

The designations 18 and 18' (FIG. 1*c*) label two single-piece, mirror-symmetrical coil arrangements of insulating plastic, each of which has one coil form 19, resp. 19' with coil flanges 20, resp. 20' and strips 21, resp. 12', so-called soldering strips, which are molded on by forming a gap 20*a*, resp. 20'*a* for the end walls 12 and 14. The coil forms 19, 19' form an L-shape with the respective strips 21, 21'. The coil forms 19, 19' are penetrated by core openings 22, 22'.

The strips 21, 21', which have solder pins 23 on their connection planes, are molded onto the coil flanges 20, 20' below the core openings 22, 22', namely in a width that is narrower in the practical example than the width of the respective limb of the iron core.

Figure 5:
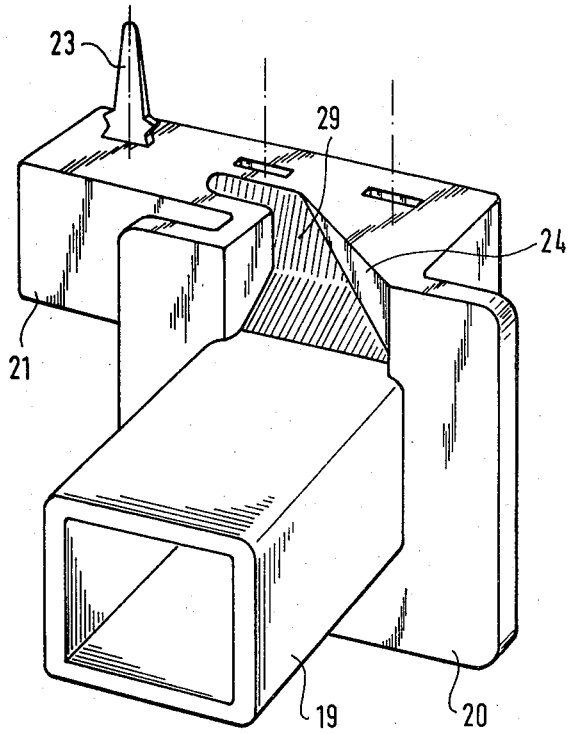
FIG. 5 is an isometric view of one unit of a coil arrangement.

As clarified in FIG. 5, a slot 24 for laying the lead-out wires, open on one side, is let into the flange 20 of the coil form 19 that carries the strip 21, reaching from the cylindrical winding form of the coil form 19 into the connection plane of the strip 21 containing the solder pins 23. The floor of a contiguous channel 29 penetrates the coil flange 20 and reaches diaginally upward to the above named connection plane of the strip 21, where it is bent into an L-shape. As FIG. 3, explained below, shows, similar slots 24, resp. channels 29, are also provided in the other coil arrangements.

Figure 3:
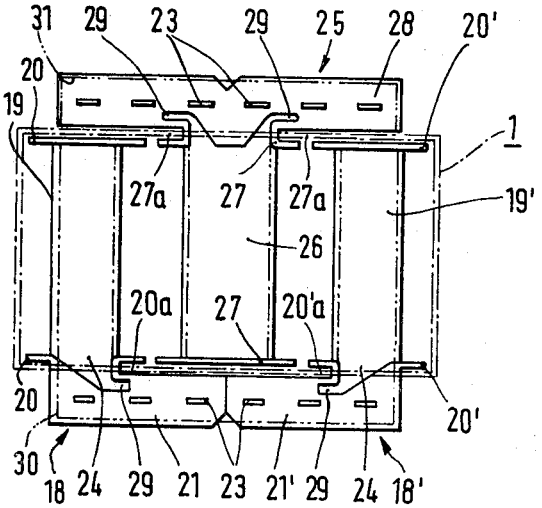

Another coil arrangement is shown in FIG. 1*a*. It is designated 25 and consists of a coil form 26 with coil flanges 27 and a molded-on strip 28, which forms a T shape with the coil form 26. The connection of the strip 28 with the coil flange 27 is the same as in the coil arrangements 18 and 18', which form a U-shape when put together. The coil arrangement 25 is associated with the center limb of a three-limbed iron core, consisting of EI-formed iron plates, for example. FIG. 3 shows a gap 27*a* between the flange 27 and the respective part of the strip 28 that is provided for the end wall 13 of the insulating housing 1, which is mounted on the opposite side of the insulating housing 1 to the previously explained end walls 12, 13, 14.

The coil arrangements 18 and 18' can be inserted into the insulating housing 1 (Shown in FIG. 1) from below, whereby the coil flanges 20, 20' are also practically enclosed all around, because of the gap 20*a*, resp. 20'*a* within the pockets 9 and 11 of the insulating housing.

The coil arrangement 25 (FIG. 1*a*) can be inserted into the pocket 10 of the insulating housing 1 in FIG. 1 from above. Here too the coil form 26, including the coil flanges 27 are extensively enclosed by the walls of the pocket 10, because of the gap 27*a* (See FIG. 3).

Figure 2:
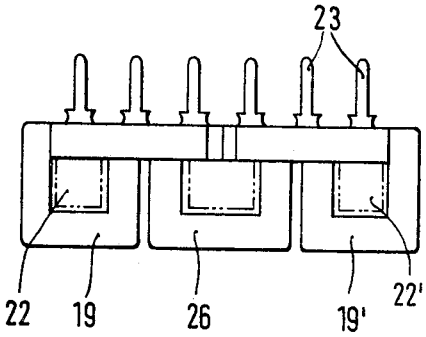
FIGS. 2, 3, and 4 are different views of the assembled coil arrangements, according to FIG. 1, with dash-dotted representation of the insulating housing.
Figure 4:
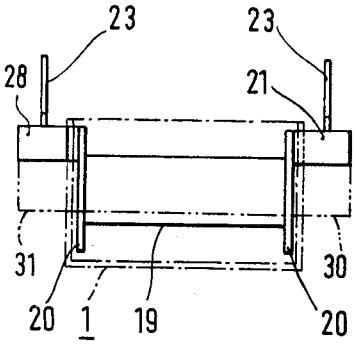

The assembly of the coil arrangements may be further illustrated in connection with FIGS. 2, 3, and 4. The strips 21 and 21' of the coil arrangements 18 and 18', whose coil forms 19, 19' are penetrated by the limbs of an EI-shaped iron core that is shown dash-dotted, present mirror-symmetry. The yokes 30, 31 of the iron core essentially lie flush on the strips 21, 21', resp. 28, namely, on the side of the strip that is opposite the already mentioned connection plane. FIGS. 3 and 4 show the position of the insulating housing 1 with respect to the coil arrangements 18, 18' and 25. It can be seen that the coil arrangements are closely enveloped by the insulating housing and are screened from the strips 21, 28 and hence from the yokes 30, 31 of the iron core. The close-tolerance cutouts 15, 16, 17 (FIG. 1*b*) and the gaps 20*a*, 20'*a*, and 27*a* result in very long air gaps and creep paths between the coil windings and the yokes 30, 31, corresponding at least to the height of the coil form flanges 20, 20', and 27 at all locations. FIG. 3 shows the position and form of the slots 24 and channels 29, (already explained in connection with FIG. 5) which penetrate the coil flanges 20, 20', 27, and hence the corresponding walls of the housing 1. In the area of the strip 28 of the coil arrangement 25, two oppositely inclined channels 29 are provided.

Figure 6A:
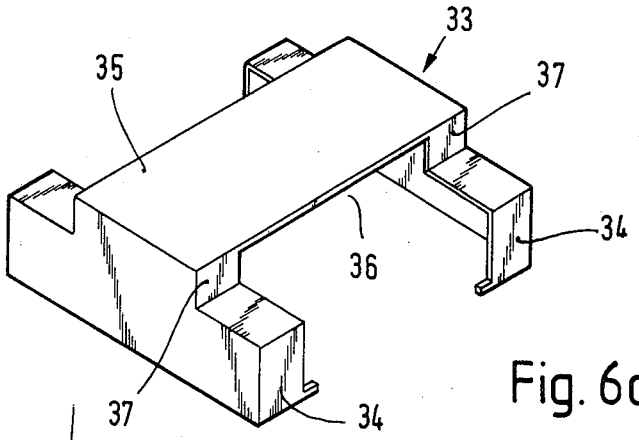
FIGS. 6*a* and 6*b* are isometric views of the assembled transformer according to the previous figures, together with an insulating housing part that can be placed onto it.
Figure 6B:
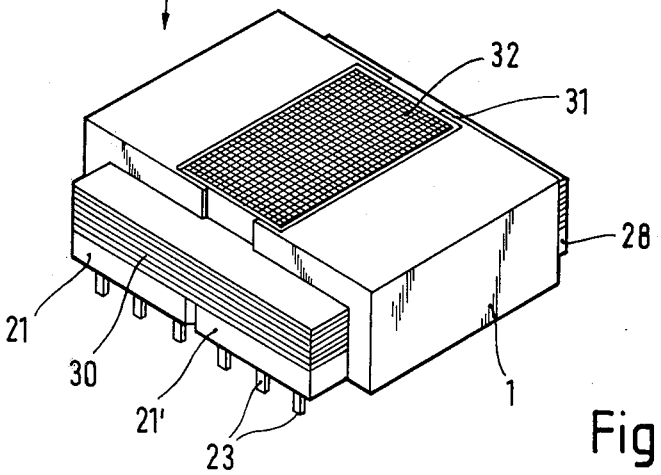

In FIG. 6*b* the transformer explained in connection with the previous figures, is shown with an iron core, whose yokes 30, 31 are recognizable and are practically congruent with their associated strips 21, 21', and 28. The coil forms of the coil arrangements 18, 18', and 25 (FIG. 1*c*) are shown with coil windings, e.g. 32, whose lead-out wires are passed through the already explained channels 29 to the solder pins 23, where they are electrically connected. The coil arrangements and strips are locked against one another by the insertable iron core in the insulating housing 1 and are firmly anchored.

Another part of the insulating housing is generally designated 33 in FIG. 6*a*. It has a cover 35, configured as a traverse, for the open side of the center coil arrangement. Onto both sides of this cover 35 two lateral shells 34 are molded, which can be elastically bent apart and placed to lock onto the yokes and the associated strips of the transformer in the direction of the arrow (between FIGS. 6*a* and 6*b*), with the shells 34 enclosing the cited yokes and strips 21, 21', 28, resp. 30, 31, on two sides and two ends.

The space 36 enclosed by the two shell sections 37 of the shells 34 and the cover 35 may serve to house a thermal safety device, which is not shown. The slots 24 and channels 29 according to FIG. 3 can also be used to lay the electrical lines associated with such a thermal safety device. This additional part of the insulating housing extensively encapsulates the transformer against the outside.

Figure 7:
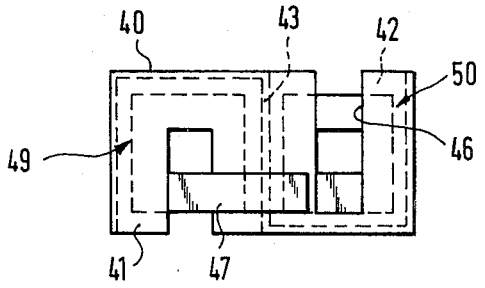
FIGS. 7 and 8 are plan views of a different embodiment of the transformer according to the invention.
Figure 8:
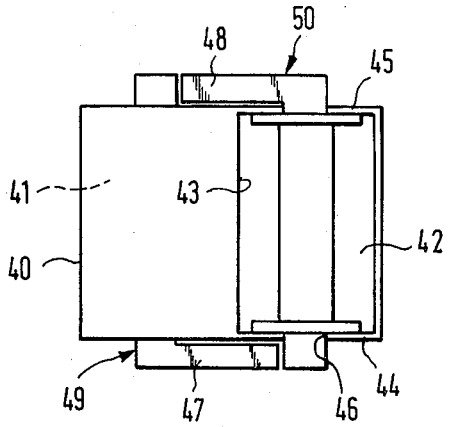

In the embodiment shown in FIGS. 7 and 8, an insulating housing 40 is provided, whose complete wave form gives it two immediately adjacent pockets 41 and 42 that are open in opposite directions and separated from each other by a wall 43. As in the previously described embodiment, these pockets are also enclosed by end walls 44, 45 at their ends, which end walls 44, 45 again contain cutouts, e.g. 46, corresponding to the limbs of the iron core in their dimensions. Two L-shaped coil arrangements 49 and 50, complemented by an iron core which is not shown, can be inserted into these pockets 41, 42 from opposite sides, together with their strips 47, 48. In this embodiment the special configuration of the insulating housing 40 also forms long air gaps and creep paths between the coil windings mutually and between the coil windings and the yokes of the iron core, as in the case of the previously described practical example.

It should be noted that the cutouts 15, 16, 17, 46 of the described end walls 12, 13, 14, 44, 45 need not necessarily merge into the respective pocket openings. If soldering strips are missing from the coil arrangements, these can still be inserted into the housing pockets 9, 10, 11, 41, 42 even if the cutouts 15, 16, 17, 46 enclose the respective core limb on all sides.

Although particular embodiments of the invention have been described and illustrated herein, it is recognized that modifications and equivalents may readily occur to those skilled in the art and, consequently, it is intended that the claims be interpreted to cover such modifications and equivalents.

What is claimed is:

1. In a transformer of the type including iron core limbs lying in one plane, each of said limbs being associated with a different one of a plurality of coil arrangements, each coil arrangement comprising a coil, wound on a flanged coil form, with the coil's lead-out wires electrically connected to terminals provided at the outside of the coil form, the improvement comprising:

an insulating housing defining pockets housing each coil arrangement, with said limbs being insertable in said coil forms through said pockets, said housing defining cutouts, which are dimensioned to facilitate the outsides of the coil forms at which the terminals are provided to extend out of said housing, and further dimensioned to accommodate the iron core limbs therein and which are at right angles with respect to the limbs and partially overlap the corresponding flanges of the coil forms.

2. In a transformer according to claim 1 wherein each coil arrangement includes terminal support means with at least a portion thereof extending outwardly from a flange of said coil form and forming a gap with respect to a selected surface of said flange, said gap being adapted to accommodate a side of the cutout in said housing.

3. In a transformer according to claim 1 wherein said transformer includes at least one coil arrangement further including terminal support means with an L-shaped structure which is connected to said coil form, with one side of said L-shaped structure extending into said coil form through the flange thereof and the other side extending outwardly from said flange.

4. In a transformer according to claim 3 wherein said transformer includes two spaced apart coil arrangements with L-shaped terminal support means arranged in mirror symmetry.

5. In a transformer according to claim 4 wherein the outer side of each L-shaped structure defines a gap with the flange of the coil form with which it is associated.

6. A transformer as recited in claim 4 wherein the pockets in said housing for housing said coil arrangements are on the same side of said housing.

7. In a transformer according to claim 4 wherein said transformer includes a third coil arrangement with terminal support means coupled to the coil form of said third coil arrangements and forming a T-shaped configuration therewith.

8. In a transformer according to claim 7 wherein the third coil arrangement is located between the two coil arrangements with the L-shaped structures, with said pockets for the coil arrangements with the L-shaped structures of the terminal support means being on one side of the housing and the pocket for the third coil arrangement being defined at a side of the housing.

9. In a transformer as recited in claim 7 wherein the outer side of each L-shaped structure defines a gap with the flange of the coil form with which it is associated.

10. In a transformer as recited in any one of claims 3, 4, 5, 6, 7, 8 or 9 wherein the flange of at least one of said coil arrangements and the portion of the terminal support means associated therewith define a channel for accomodating at least one of the lead-out wires of the coil wound on said flanged coil form.

11. In a transformer as recited in any of claims 7 or 8 wherein the transformer further includes cover means defining a cover plate for covering the third coil arrangement located in a pocket of said housing, said cover means further including two shell means extending from opposite sides of said cover plate, for substantially enclosing at least the sides of the terminal support means which extend out of the flanges of the coil arrangements, except for the terminals, which are supported by said terminal support means.

* * * * *